US005561865A

United States Patent [19]

Fjelstul

[11] Patent Number: 5,561,865

[45] Date of Patent: Oct. 8, 1996

[54] OUTERWEAR GARMENT WITH INTEGRAL STORAGE POUCH

[75] Inventor: Jill K. Fjelstul, Fruitland Park, Fla.

[73] Assignee: Personal Best, Inc., Fruitland Park, Fla.

[21] Appl. No.: 324,109

[22] Filed: Oct. 14, 1994

[51] Int. Cl.[6] ..... A41D 1/06

[52] U.S. Cl. ..... 2/227; 2/228; 2/247

[58] Field of Search ..... 2/227, 228, 238, 2/247, 249, 250, 400, 69, 79, 80, 94, 93; 224/224

[56] References Cited

U.S. PATENT DOCUMENTS

| | | | |
|---|---|---|---|
| 815,063 | 3/1906 | Brigham | 2/247 |
| 1,708,786 | 4/1929 | Cohen | 2/247 |
| 3,137,862 | 6/1964 | Mizerak | 2/400 |
| 4,029,243 | 6/1977 | Zerobnick et al. | 224/224 |
| 4,602,390 | 7/1986 | Morera et al. | 2/247 |
| 5,050,244 | 9/1991 | Kleinman | 2/79 |
| 5,204,995 | 4/1993 | Knapp | 2/247 |

FOREIGN PATENT DOCUMENTS

| | | | |
|---|---|---|---|
| 238070 | 9/1945 | Switzerland | 224/224 |

OTHER PUBLICATIONS

Sears Catalog, p. 74, Item 7–Overalls, Dec. 1980.

*Primary Examiner*—C. D. Crowder
*Assistant Examiner*—Gloria Hale
*Attorney, Agent, or Firm*—Gerald E. Linden

[57] ABSTRACT

A storage pouch is formed integrally with an outerwear garment such as a pair of shorts, such as by sewing a semi-circular piece of fabric on a front or back, interior or exterior surface of the outerwear garment. For storage pouches formed on an exterior surface of the outerwear garment, a slit is provided in the storage pouch and the slit is closed off by a zipper or a hook-and-loop type fastening device. For storage pouches formed on an interior surface of the outerwear garment, a slit is provided in the outerwear garment itself, and the slit is closed off by a zipper or a hook-and-loop type fastening device. The storage pouch can be formed of the same material (e.g., color, pattern, fabric) as the outerwear garment, thereby substantially camouflaging the storage pouch. The zipper can be covered by a flap of material extending from above the slit, to more fully camouflage the existence of the storage pouch. The storage pouch may have a V-shaped bottom, or may have a box-type bottom. Forming a storage pouch integrally with an outerwear garment is relatively advantageous (over using a separate and distinct storage pouch) since the integral storage pouch can be color and design coordinated with the material of the shorts; the integral storage pouch cannot be misplaced or lost, or unlatched (removed) by vandals; the integral storage pouch will not sag, and will not require re-adjustment; and the integral pouch will not catch on other, extraneous objects such as doorknobs.

19 Claims, 4 Drawing Sheets

OUTERWEAR GARMENT WITH INTEGRAL STORAGE POUCH

TECHNICAL FIELD OF THE INVENTION

The invention relates to wearing apparel, namely outerwear garments covering the body from the waist, downward, to the thigh, knee or ankle, such as trousers, pants, "bottoms" (as in the lower part of an athletic warm-up suit) or shorts.

BACKGROUND OF THE INVENTION

Outerwear garments can generally be classified into two distinct categories: "upper" garments that cover a person's torso (between the neck and the waist) and "lower" garments that cover a persons body from the waist downward. A shirt or blouse is exemplary of upper garments. Trousers, pants, "bottoms" (as in the lower part of an athletic warm-up suit) and shorts are exemplary of lower garments. In the main hereinafter, shorts are discussed as exemplary of lower outerwear garments.

As shown in FIG. 1, shorts 100 typically have a front portion which may be formed of two generally-rectangular panels 102*a* and 102*b* joined (stitched together) by a seam 102*c*, and a back portion which may be formed of two generally rectangular panels 104*a* and 104*b* joined (stitched together) by a seam 104*c*. The front and back portions of the shorts are joined (stitched) to one another at their outer edges 106 and 108. In this manner, a relatively large opening 110 is formed at the top (as viewed and as worn) of the shorts for accommodating a person's waist. The inner edges of the corresponding front and back panels 102*a*/104*a* and 102*b*/104*b* are joined (stitched) together by a two seams 116 and 118, respectively, said seams commencing at the bottom edges 112, 114 of the panels and extending only partially towards the top opening 110. This forms two leg portions of the shorts 100 which fit about a person's upper thighs. Pockets (not shown) are typically provided in the shorts, extending from openings (not shown) disposed at or near the side edges 106 and 108 of the shorts. If the leg portions were longer, the shorts would be considered to be pants or trousers.

Typically, as shown in FIG. 1A, a waistband 120 is formed at the periphery of the top opening 110 by folding a peripheral region of the respective panels (102*a*, 102*b*, 104*a*, 104*b*) back upon themselves and joining (stitching) the top edge of the respective panel (stitches indicated as 124). An elongated elastic band 122 may be disposed within the resulting tubular passageway formed by folding the edges over. The waistband is defined by the seam of stitches 124, and is typically approximately one-inch in height (as viewed in the figure).

Pants (e.g., shorts) pockets may (or may not) include means for closing off the pocket (e.g., buttons, zippers, hook-and-loop type fasteners). In the absence of such means for closing off the pockets, the contents of the pockets (e.g., keys, money) are not securely retained within the pockets. This is especially troublesome for an active wearer, since activity (e.g., running) itself may cause contents to fall out of an unclosed pocket.

FIG. 2 illustrates a representative storage pouch 200 of the prior art, sometimes called a "fanny" pack (although the pouch is often worn so that it is disposed on the person's front side, rather than on the person's back side) such as has gained popularity in recent years. Generally, a pouch 202 is attached to a belt 204 and is intended to be worn about a person's waist so that the pouch 202 hangs downward from the person's waist. Each end of the belt is provided with a means 206, 208 for fastening the ends of the belt to one another, and there is typically provided a means (not shown) for adjusting the circumference of the belt so that it fits properly around the person's waist. The pouch 202 is provided with one or more zippers 210 (one shown) allowing the user access into the interior of the pouch for securely storing personal items such as money, keys, credit cards, sunglasses, and the like. In use, a person would wear the fanny pack 200 approximately over the waistband of their pants (e.g., shorts). In this manner, the user is provided with storage pouch for transporting personal items, on their person. Such a separate and distinct storage pouch 200, however, is typically of a color and/or design that may clash with (i.e., be dissimilar from) the color and/or design of the person's pants (shorts), can easily be misplaced or lost, or unlatched (removed) by vandals, may tend to sag which requires the user to re-adjust the belt of the storage pouch, and which can catch (snag) on other, extraneous objects such as doorknobs.

DISCLOSURE OF THE INVENTION

It is therefore an object of the present invention to provide an improved technique for providing a user with transportable storage for personal items.

According to the invention, a storage pouch is formed integrally with an outerwear garment such as shorts. As used herein, the term "shorts" includes trousers (pants) of any length, and of any fabric (e.g., cotton blend).

The storage pouch is formed on at least one of the two "sides" (front portion, back portion) of the outerwear garment.

A means for closing an opening (slit) in the storage pouch, such as a zipper or a hook-and-loop type fastening device is provided, so that the contents of the integral storage pouch will remain secure.

By virtue of the storage pouch being formed integrally with the outerwear garment, the storage pouch can be formed of the same material (e.g., color, pattern, fabric) as the outerwear garment, thereby substantially camouflaging the storage pouch.

In one embodiment of the invention, the means for closing the slit (e.g., the zipper) is exposed (visible to an onlooker).

In another embodiment of the invention, the means for closing the slit is hidden by a flap of material. In this manner, the storage pouch can be even better camouflaged with the fabric of the outerwear garment, so as to be virtually invisible to an onlooker.

In another embodiment of the invention, the integral storage pouch is formed with a box-type bottom, providing the user with increased room for storing personal effects.

Numerous advantages of the storage pouch formed integrally with the shorts over conventional separate and discrete fanny packs include:

- the integral storage pouch can be color and design coordinated with the material of the shorts;
- the integral storage pouch cannot be misplaced or lost, or unlatched (removed) by vandals;
- the integral storage pouch will not sag, and will not require re-adjustment; and
- the integral pouch will not catch on other, extraneous objects such as doorknobs.

Other objects, features and advantages of the invention will become apparent in light of the following description thereof.

DETAILED DISCLOSURE OF THE INVENTION

Figure 1:
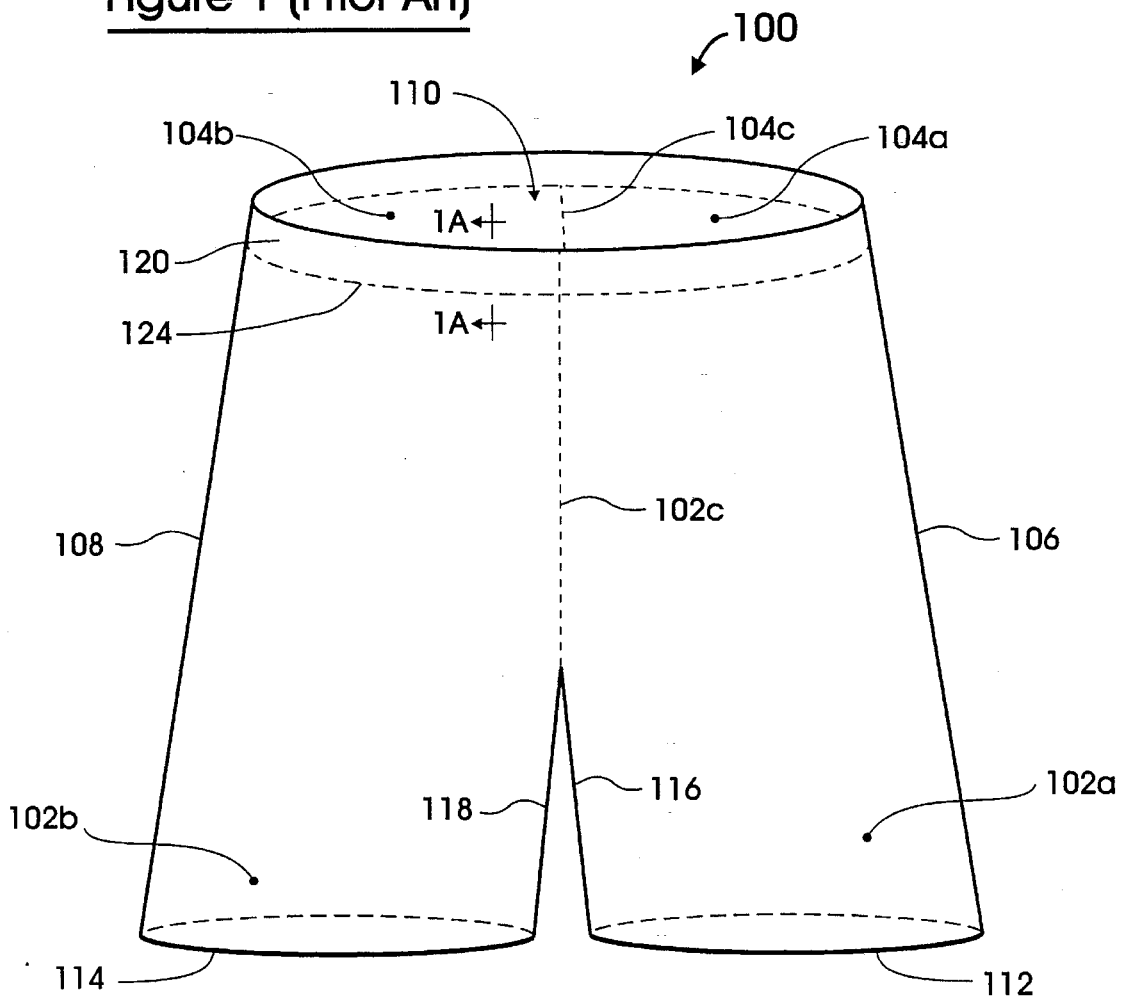
Figure 1 (Prior Art)
FIG. 1 is a perspective view of a pair of shorts of the prior art.
Figure 2:
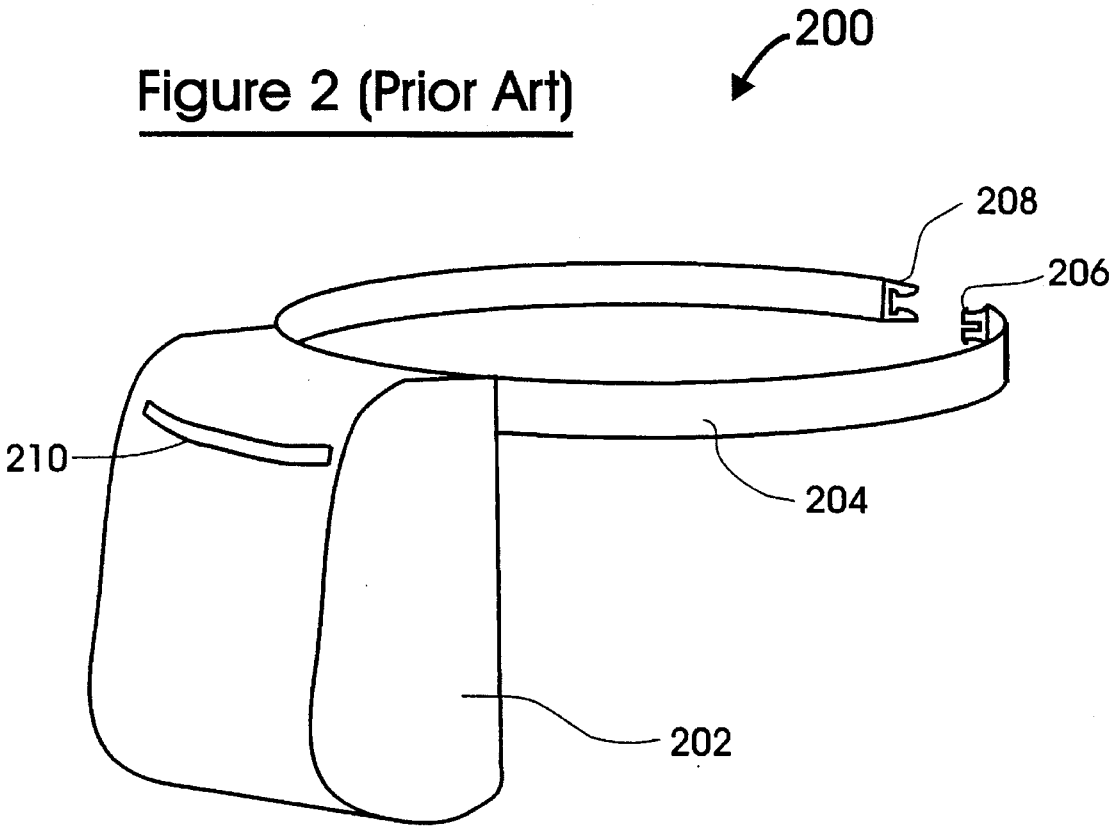
Figure 2 (Prior Art)
FIG. 2 a is a perspective view of a storage pouch of the prior art.
Figure 1A:
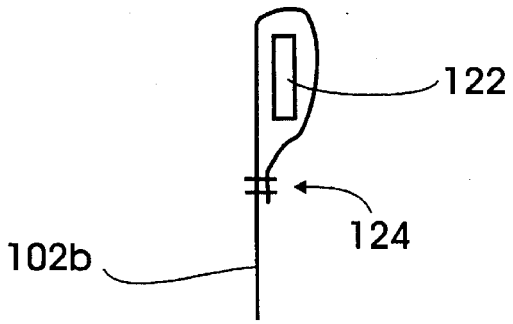
Figure 1A (Prior Art)
FIG. 1A is a cross-sectional view of a portion of the shorts shown in FIG. 1.

FIG. 1 and 1A illustrate a pair of shorts 100 formed according to the prior art, and FIG. 2 illustrates a non-integral, separate and distinct storage pouch 200 formed according to the prior art. These drawings have been discussed hereinabove.

Figure 3:
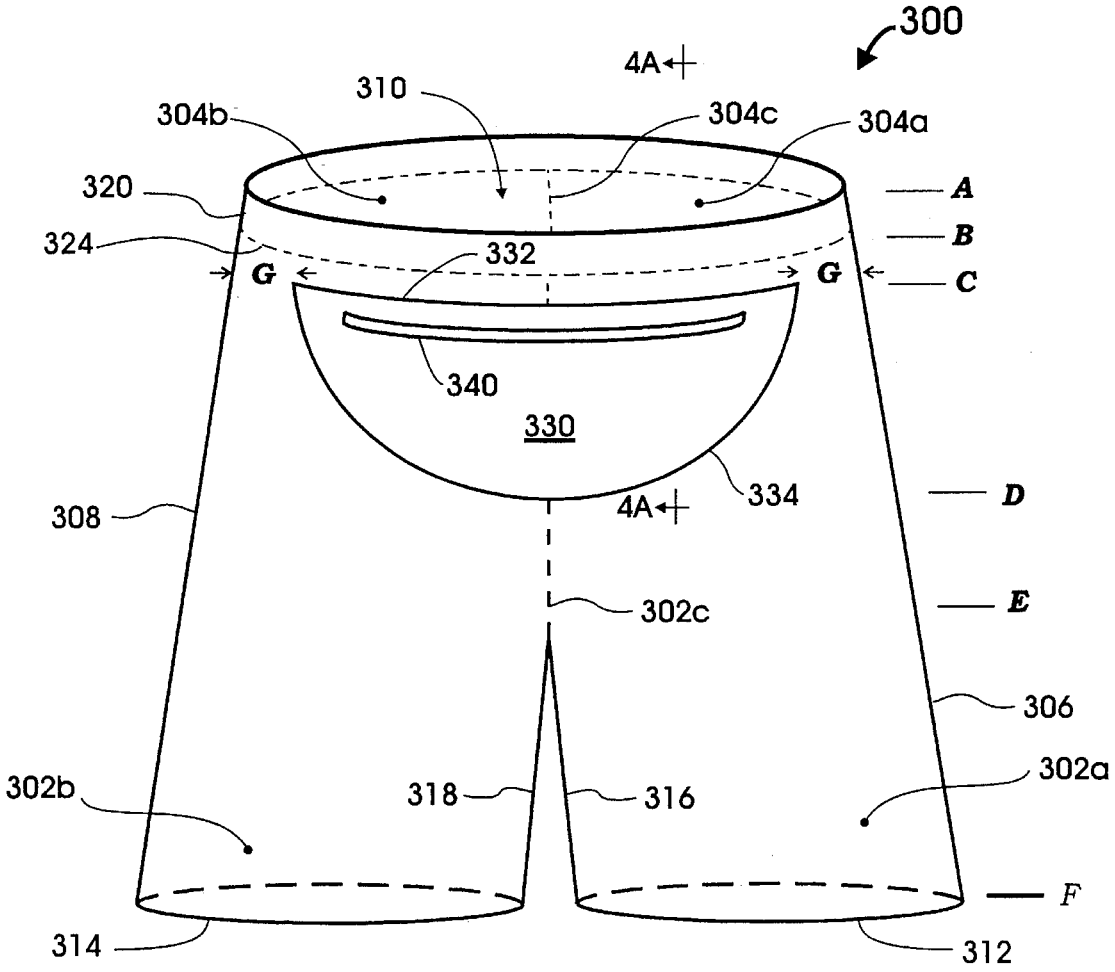
FIG. 3 is a perspective view of an outerwear garment, according to the present invention which may utilize, by way of example, various elements shown in the prior art shorts of FIG. 1. Elements common to FIGS. 1 and 3 are similarly labelled, in that an element "1xx" of FIG. 1 would be labelled "3xx" in FIG. 3.

FIG. 3 shows an outerwear garment, by way of example a pair of shorts 300, according to the present invention. The general construction of the pair of shorts 300 is similar to that of the pair of shorts 100 shown in FIG. 1, in that the shorts may be made of four generally rectangular panels 302*a* (corresponding to 102*a*), 302*b* (corresponding to 102*b*), 304*a* (corresponding to 104*a*), and 304*b* (corresponding to 104*b*). Two panels 302*a* and 302*b* form the front (or anterior) portion of the shorts 300. Two panels 304*a* and 304*b* form the back (posterior) portion of the shorts 300.

The shorts 300 of the present invention are provided with an integral storage pouch 330, incorporated into the construction of the shorts, as follows. A generally semi-circular piece of fabric is sewn onto the front (front portion) of the shorts, preferably centered in the abdominal area, with a top, generally straight edge 332 of the semi-circular piece of fabric aligned towards the waistband 320 of the shorts 300, and a generally semi-circular rounded edge 334 of the semi-circular piece of fabric extending from ends of the straight top edge 332 towards the legs of the shorts. Certain dimensions of the pouch 330, and its orientation on shorts are critical, wherein:

A denotes the vertical (as viewed in the figure) position of the top edge of the shorts;

B denotes the vertical (as viewed in the figure) position of the waistband seam 324;

C denotes the vertical (as viewed in the figure) position of the top edge 332 of the integral storage pouch 330;

D denotes the vertical (as viewed in the figure) position of a lowermost extreme of the bottom (curved) edge 334 of the integral storage pouch 330;

E denotes the vertical (as viewed in the figure) position of the intersection of the two leg portions of the shorts 330;

F denotes the vertical (as viewed in the figure) position of the bottom edges 312, 314 of the leg portions of the shorts; and G denotes the distance between respective ends of the straight top edge 332 and the side edges 306 and 308 of the shorts. As noted above, the pouch 330 is preferably centered on the front portion of the shorts.

The vertical (as viewed in the figure) extent of the waistband, between the positions A and B is approximately one inch.

The top edge 332 of the integral storage pouch 330 is preferably disposed exactly at the waistband seam 324, so that when the top edge 332 is stitched, the stitching blends into the stitching of the waistband seam. In such a case, the positions B and C are identical. However, the top edge 332 of the integral storage pouch 330 can be disposed lower than the waistband seam, so that the vertical extent between the positions B and C is approximately one-quarter to one-half inch (in other words, approximately 25%–50% of the vertical extent of the waistband).

Outerwear such as shorts is typically made available in a variety of sizes. For purposes of this example, the shorts 300 are intended to fit a person of average build having a 30 inch waist. The vertical extent between the positions C and D (in other words, the height of the integral storage pouch) is 5–6 inches (in other words, approximately 15%–20% of the circumference of the waistband).

The distance between the bottom edge 334 of the integral storage pouch 330 and the inseam (junction of the tops of the two leg portions), in other words the vertical extent between the positions D and E is 5–6 inches (in other words, approximately equal to the height of the integral storage pouch).

The vertical (as viewed in the figure) extent between the positions E and F defines the length of the leg portions, and is generally immaterial to the critically of the invention. If the length of the leg portions is less than the length of the wearer's legs, the outerwear garment under consideration would be considered to be "shorts". If the length of the leg portions is approximately equal to the length of the wearer's legs, the outerwear garment under consideration would be considered to be "pants".

The integral storage pouch 330 extends nearly, but preferably not entirely, across the front (front portion) of the shorts 330. As viewed in the figure, there is a space (offset) G between the sidemost extremes (there are two, on the left and one on the right) of the integral storage pouch 330 and the respective side edges 306, 308 of the shorts 330. This space G is (in the example of a pair of shorts fitting a thirty inch waist) 3–4 inches.

For a pair of shorts fitting a 30 inch waist, the overall distance across the front (front portion) of the shorts (i.e., from side edge 306 to side edge 308) is 15 inches. (This assumes that the back portion of the shorts is made the same size as the front portion of the shorts. In practice, the back portion may be formed slightly larger than the front portion.) This, in conjunction with the aforementioned exemplary space G, indicates that the horizontal (as viewed in the figure) extent, or width, of the integral storage pouch 330 would be 9 inches. In other words, the horizontal extent (e.g., 9 inches) of the integral storage pouch 330 is approximately 1.5 times larger than the height (e.g., 5–6 inches) of the integral storage pouch 330. In other words, an "aspect ratio" of width:height for the storage pouch is on the order of 3:2±10%.

As mentioned hereinbefore, one of the advantages of the integral storage pouch of the present invention is that it can be "color-coordinated" with the fabric of the shorts itself. The integral storage pouch can, in fact, be fabricated of the same material as the panels (302*a*, 302*b*, 304*a*, 304*b*) of the shorts. This feature is advantageous in that the fact that the user is wearing a storage pouch, likely to contain valuables, will be less conspicuous and less obvious to other people. The color and/or fabric coordination inherent in making a storage pouch integral with the outerwear garment itself will also address the user's fashion consciousness.

A suitable fastener 340, such as a zipper or a hook-and-loop type fastener, is provided near the top of the integral storage pouch 330, and extends nearly entirely across the width of the integral storage pouch 330, and provides the user with facile access to the interior of the integral storage pouch 330 (for inserting and removing articles from the pouch). This, of course, means that a slit must be provided in the fabric of the integral storage pouch, wherein said slit can be securely closed off by the fastener 340.

Figure 4A:
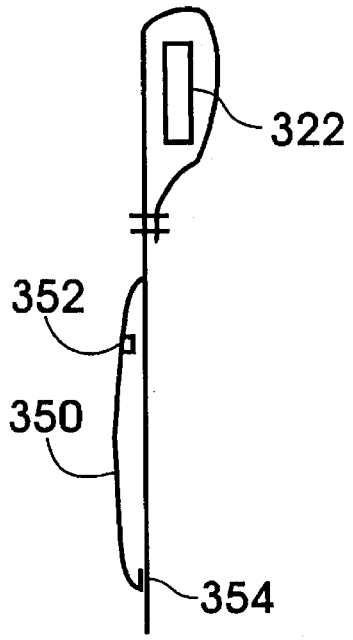
FIG. 4A is a cross-sectional view of a portion of an outerwear garment, such as is shown in FIG. 3, illustrating a one embodiment of the invention.

FIG. 4A shows a one embodiment of a storage pouch 350 formed integrally with an outerwear garment, such as the storage pouch 330 formed on the shorts 300 of FIG. 3. This is the simplest embodiment of the invention, wherein the pouch 350 is formed by sewing a piece of fabric on the exterior surface of the front (front portion) of the outerwear garment, and has a "V"-shaped bottom. A zipper 352 (corresponding to 340 in FIG. 3) is illustrated. Preferably, said zipper 352 is color-coordinated with the fabric of the pouch 350 which, in turn, is preferably color-coordinated with the fabric of the outerwear garment. The waistband of the garment may be elasticized, as indicated by element 322 (compare FIG. 3). The bottom (curved) edge of the pouch 350 is sewn in any suitable manner to the fabric of the outerwear garment, as indicated by the arrow 354.

Figure 4B:
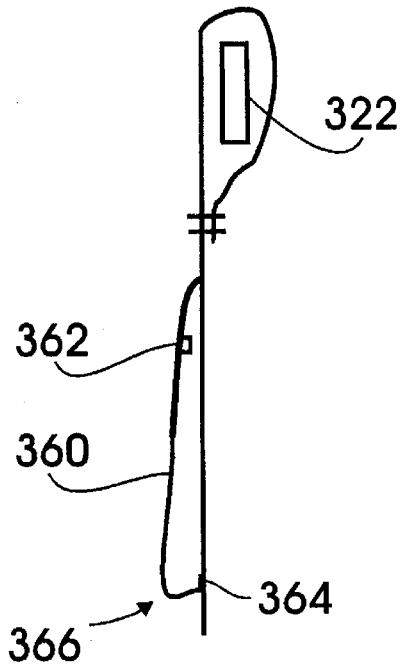
FIG. 4B is a cross-sectional view of a portion of an outerwear garment, such as is shown in FIG. 3, illustrating another embodiment of the invention.

FIG. 4B shows another embodiment of a storage pouch 360 formed integrally with an outerwear garment, such as the storage pouch 330 formed on the shorts 300 of FIG. 3. In this embodiment, the pouch 360 is formed in a manner similar to the pouch 350 of FIG. 4A—namely by sewing a piece of fabric on the exterior surface of the front (front portion) of the outerwear garment. A zipper 362 (corresponding to 340 in FIG. 3) is illustrated. Preferably, said zipper 362 is color-coordinated with the fabric of the pouch 360 which, in turn, is preferably color-coordinated with the fabric of the outerwear garment. The waistband of the garment may be elasticized, as indicated by element 322 (compare FIG. 3). In this embodiment, the bottom of the pouch 360 is formed with an expandable, box-type bottom-namely by having an additional (to the seam 364, corresponding to the seam 354 of FIG. 4A) seam at the position indicated by the arrow 366.

Figure 4C:
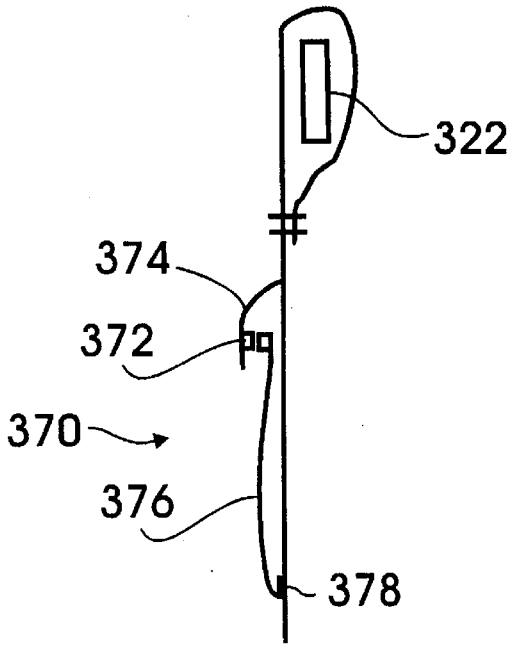
FIG. 4C is a cross-sectional view of a portion of an outerwear garment, such as is shown in FIG. 3, illustrating another embodiment of the invention.

FIG. 4C shows another embodiment of a storage pouch 370 formed integrally with an outerwear garment, such as the storage pouch 330 formed on the shorts 300 of FIG. 3. In this embodiment, the pouch 370 is formed in a manner similar to the pouch 350 of FIG. 4A-namely by sewing a piece of fabric on the exterior surface of the front (front portion) of the outerwear garment. The storage pouch 370 could also be formed with a box-type (rather than a "V"-type) bottom, in a manner similar to the storage pouch 360 of FIG. 4A. This embodiment differs from the previous two embodiments in that the zipper 372 is hidden from view of an onlooker. This is accomplished by allowing a portion 374 of the material forming the storage pouch which is above the opening (slit) to overlap a portion 376 of the material forming the storage pouch which is below the opening (slit). In this case, the zipper 372 is entirely hidden from view, and need not be color-coordinated with the material of the pouch. As in the embodiments of the invention discussed hereinabove, the waistband of the garment may be elasticized, as indicated by element 322 (compare FIG. 3). The bottom (curved) edge of the pouch 370 is sewn in any suitable manner to the fabric of the outerwear garment, as indicated by the arrow 378.

Figure 4D:
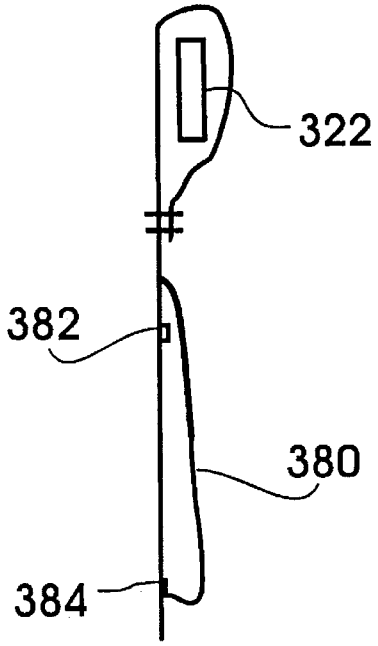
FIG. 4D is a cross-sectional view of a portion of an outerwear garment, such as is shown in FIG. 3, illustrating another embodiment of the invention.

FIG. 4D shows another embodiment of a storage pouch 380 formed integrally with an outerwear garment, in a manner similar to the storage pouch 330 formed on the shorts 300 of FIG. 3. In this embodiment of the invention, the pouch is formed on an interior surface of the outerwear garment, rather than on an exterior surface of the outerwear garment. The storage pouch can be formed with (compare FIG. 4B) or without (compare FIGS. 4A and 40) a box bottom. In this embodiment, the pouch 380 is formed by sewing a piece of fabric on the interior surface of the front (front portion) of the outerwear garment. A zipper 382 (corresponding generally to the zipper 340 of FIG. 3) is illustrated, and is suitable for closing a slit opening formed in the material of the outerwear garment itself, to allow the user access to the interior of the storage pouch. If the zipper 380 is exposed, it is preferably said color-coordinated with the fabric of the outerwear garment. If the zipper 380 is not exposed (i.e., by allowing a portion of the outerwear garment material to overhang the zipper, in a manner similar to the technique discussed with respect to the embodiment of FIG. 4C), the zipper need not be color-coordinated with either the material of the outerwear garment or the material of the storage pouch. Moreover, in this embodiment, the material of the storage pouch need not be color-coordinated with the material of the outerwear garment, since the pouch is entirely hidden on the inside of the outerwear garment. This interior location of the integral storage pouch allows for the choice of virtually any material for forming the integral storage pouch. For example, the outerwear garment may be formed of a 50/50 cotton/polyester blend, and the storage pouch may be formed of a sturdier material (e.g., canvas). As in the previous embodiments, the waistband of the garment may be elasticized, as indicated by element 322 (compare FIG. 3). The bottom (curved) edge of the pouch 380 is sewn in any suitable manner to the fabric of the outerwear garment, as indicated by the arrow 384.

It would evidently be somewhat problematic for a male user to wear a pair of shorts having an integral storage pouch disposed on the front (front portion) of his shorts. It is therefore within the scope of this invention that the integral storage pouch (e.g., 330) be disposed on the back of the shorts rather than on the front (front portion) of the shorts. In such a case, references herein to "front" (front portion) should be considered to include "back" (back portion). In a generic sense, an outerwear garment such as a pair of shorts has two opposite "sides"—the front side and the back side, referred to herein as "portions"—and the integral storage pouch of this invention can be disposed either on the front or on the back of the outerwear garment, either on an inside (inner) surface or on an outer (outside) surface of the outerwear garment.

Although the invention has been illustrated and described in detail in the drawings and foregoing description, the same is to be considered as illustrative and not restrictive in character—it being understood that only preferred embodiments have been shown and described, and that all changes and modifications that come within the spirit of the invention are desired to be protected.

What is claimed is:

1. Shorts with an integral storage pouch, comprising:

shorts having a front portion defining an abdominal area, a back portion, a waist and a crotch;

a storage pouch formed of a single generally semi-circular piece of fabric sewn onto a one of the front or back portions of the shorts, centered upon the one of the front or back portions of the shorts, a top straight edge of the semi-circular piece of fabric aligned towards the waistband, a semi-circular rounded edge of the semi-circular piece of fabric extending from ends of the top straight edge towards the crotch;

wherein:

the storage pouch has a width and extends substantially across the one of the front or back portions of the shorts; and the storage pouch has a height and extends from adjacent the waist substantially to a position halfway from the waist to the crotch.

2. Shorts, according to claim 1, wherein:

the width of the storage pouch is 1.35 to 1.65 times the height of the storage pouch.

3. Shorts, according to claim 1, further comprising:

a slit formed in the storage pouch; and means for opening and closing the slit in the storage pouch.

4. Shorts, according to claim 3, wherein: the means for closing the slit is a zipper.

5. Shorts, according to claim 4, wherein: the zipper is exposed.

6. Shorts, according to claim 4, wherein:

the zipper is disposed behind a flap of material forming the storage pouch.

7. Shorts, according to claim 1, wherein:

the shorts are formed of a first material; and the storage pouch is formed of a material which is the same as the material of the shorts.

8. Shorts, according to claim 1, wherein:

the storage pouch is centered on the front portion of the shorts.

9. Shorts, according to claim 1, wherein:

the storage pouch is centered on the back portion of the shorts.

10. Shorts, according to claim 1, wherein:

the storage pouch is disposed on an outer surface of the shorts.

11. Shorts, according to claim 1, wherein:

the storage pouch is disposed on an inner surface of the shorts.

12. Shorts, according to claim 1, wherein:

the storage pouch has a "V"-shaped bottom.

13. Shorts according to claim 1, wherein:

the storage pouch has an expandable, box-type bottom.

14. Shorts, according to claim 1, wherein:

the storage pouch has the same color and design as the shorts.

15. A pair of shorts, according to claim 1, wherein:

the top edge of the storage pouch is disposed within one-half inch of the waistband; and the height of the storage pouch is approximately 15%–20% of the circumference of the waistband.

16. A pair of shorts, according to claim 1, further comprising:

a zippered opening allowing a user access to an interior of the storage pouch.

17. A pair of shorts, according to claim 16, wherein:

the zippered opening includes a zipper covered by a flap of material forming the storage pouch.

18. A pair of shorts, according to claim 1, wherein:

the width of the integral storage pouch is approximately 1.5 times larger than the height of the integral storage pouch.

19. A pair of shorts, according to claim 1, wherein:

the storage pouch is formed on an outer surface of the shorts;

further comprising:

a zippered opening allowing a user access to an interior of the storage pouch.

* * * * *